United States Patent [19]

Dorer, Jr. et al.

[11] 4,032,304

[45] June 28, 1977

[54] FUEL COMPOSITIONS CONTAINING ESTERS AND NITROGEN-CONTAINING DISPERSANTS

[75] Inventors: Casper John Dorer, Jr., Lyndhurst; Clark Ober Miller, Willoughby Hills, both of Ohio

[73] Assignee: The Lubrizol Corporation, Wickliffe, Ohio

[22] Filed: Sept. 3, 1974

[21] Appl. No.: 502,593

[52] U.S. Cl. ..... 44/70; 44/66

[51] Int. Cl.[2] ..... C10L 1/22

[58] Field of Search ..... 44/58, 66, 70, 71; 252/51.5 A

[56] References Cited

UNITED STATES PATENTS

| | | | |
|---|---|---|---|
| 2,585,843 | 2/1952 | Rogers | 44/66 |
| 2,798,798 | 7/1957 | Marsh et al. | 44/66 |
| 3,219,666 | 11/1965 | Norman et al. | 252/51.5 A |
| 3,658,495 | 4/1972 | Dorer, Jr. | 44/66 |
| 3,836,469 | 9/1974 | Miller | 44/66 |

*Primary Examiner*—Daniel E. Wyman
*Assistant Examiner*—Mrs. Y. Harris-Smith
*Attorney, Agent, or Firm*—James W. Adams, Jr.; William H. Pittman

[57] ABSTRACT

Improved fuel compositions with decreased tendency to form deposits in the carburetor and on "early fuel evaporation" heating elements, inlet valves and the like contain a normally liquid fuel (usually a hydrocarbon fuel), a carboxylic acid ester of lubricating viscosity, and an oil-soluble nitrogen-containing dispersant. The dispersant is characterized by the presence therein of a substantially saturated hydrocarbon-based radical having at least about 50 carbon atoms, and it is preferably a carboxylic dispersant (e.g., the reaction product of a polyisobutenyl succinic acid-producing compound with a polyethylene polyamine) or a Mannich-type dispersant (e.g., the reaction product of an alkyl phenol with formaldehyde and a polyethylene polyamine).

19 Claims, No Drawings

FUEL COMPOSITIONS CONTAINING ESTERS AND NITROGEN-CONTAINING DISPERSANTS

INTRODUCTION AND DESCRIPTION OF THE INVENTION

This invention relates to new compositions of matter suitable for use as internal combustion engine fuels. More particularly, it relates to fuel compositions comprising a major amount of (A) a normally liquid fuel and a minor amount of the combination of (B) at least one carboxylic acid ester of lubricating viscosity and (C) an oil-soluble nitrogen-containing dispersant characterized by the presence within its molecular structure of a substantially saturated aliphatic hydrocarbon-based radical having at least about 50 carbon atoms.

The development of fuels containing dispersants to promote carburetor cleanliness has been of increasing interest recently. Still more recently, an "early fuel evaporation" system has been developed to aid in the reduction of emissions from engines burning gasoline and similar volatile fuels. The early fuel evaporation system contains an element adapted to heat the air-fuel mixture before its entry into the carburetor, whereby evaporation is well under way by the time the fuel reaches the engine.

Non-volatile constituents of the fuel, such as additives, sometimes form deposits or varnish on inlet valves and on heating elements such as the early fuel evaporation element. Such deposits and varnish impair the efficiency of these elements. It is therefore of interest to provide additive systems which tend to decrease such deposition and varnish formation, while at the same time permitting or encouraging carburetor dispersancy as provided by heretofore known dispersant additives.

A principal object of the present invention, therefore, is to prepare improved fuels.

A further object is to provide fuels having carburetor dispersancy properties comparable to that of the fuels heretofore known, while at the same time inhibiting fouling of and varnish deposition on inlet valves and on heating elements such as the early fuel evaporation heater.

Other objects will in part be obvious and will in part appear hereinafter.

COMPONENT A

Component A in the compositions of this invention is a normally liquid fuel, usually a hydrocarbonaceous petroleum distillate fuel such as aviation or motor gasoline, as defined by ASTM Specification D-439-73, or diesel fuel or fuel oil as defined by ASTM Specification D396. Fuels containing non-hydrocarbonaceous materials such as alcohols, ethers, organonitro compounds and the like are also useful as the liquid fuels derived from vegetable or mineral sources such as corn, alfalfa, shale and coal. Particularly preferred is gasoline, that is, a mixture of hydrocarbons having an ASTM boiling point of about 60°C. at the 10% distillation point to about 205°C. at the 90% distillation point.

COMPONENT B

Component B is at least one carboxylic acid ester of lubricating viscosity. Many such esters are known in the art. They are typically prepared by the reaction of a $C_{3-36}$ aliphatic acid of the formula $R(COOH)_n$, wherein R is an aliphatic hydrocarbon-based radical which is preferably substantially saturated, $n$ is an integer from 1 to 3, with a $C_{4-20}$ aliphatic alcohol of the formula $R'(OH)_m$ wherein R' is an aliphatic hydrocarbon-based radical and $m$ is an integer from 1 to 6.

As used herein, the term "aliphatic hydrocarbon-based radical" denotes an aliphatic radical having a carbon atom directly attached to the remainder of the molecule and having predominantly hydrocarbon character within the context of this invention, and "substantially saturated" means that the radical contains no acetylenic unsaturation and at lest about 95% of the carbon-to-carbon bonds therein are saturated. Suitable radicals include the following:

1. Aliphatic radicals (which are preferred).
2. Substituted aliphatic radicals; that is, aliphatic radicals containing non-hydrocarbon substituents which, in the context of this invention, do not alter the predominantly hydrocarbon character of the radical. Those skilled in the art will be aware of suitable substituents (e.g., halo, hydroxy, alkoxy, aldehydo, keto, carbalkoxy, amido, nitro, cyano, sulfoxy, sulfone, sulfide, disulfide, mercapto).
3. Aliphatic hetero radicals; that is, aliphatic radicals which, while predominantly hydrocarbon in character within the context of this invention, contain atoms other than carbon present in a chain otherwise composed of carbon atoms. Suitable hetero atoms will be apparent to those skilled in the art and include, for example, oxygen, sulfur and nitrogen.

In general, no more than about three substituents or hetero atoms, and preferably no more than one, will present for each 10 carbon atoms in the aliphatic hydrocarbon-based radical.

In one embodiment of the invention, component B is at least one liquid ester of an aliphatic monocarboxylic acid, preferably in the $C_{5-36}$ range and especially in the $C_{5-10}$ range, and a polyol. Suitable acids are valeric, caproic, pivalic, caprylic, capric, enanthic, pelargonic, 2-ethylhexanoic, dodecanoic, stearic, eicosanoic, triacontanoic and hexatriacontanoic acids. The polyols with which they may be reacted are preferably those in the $C_{2-10}$ range including neopentyl glycol, trimethylolethane, trimethylolpropane, trimethylolbutane, pentaerythritol and dipentaerythritol. Especially preferred are the pentaerythritol, dipentaerythritol and tripentaerythritol esters of mixtures of monocarboxylic acids in the $C_{5-10}$ range, wherein a substantial proportion of the acid mixture consists of straight-chain aliphatic carboxylic acids.

Component B may also be at least one liquid ester of an aliphatic polycarboxylic acid and a monohydroxy alcohol. Suitable acids of this type are malonic, alkyl- or alkenylmalonic, succinic, alkyl- or alkenylsuccinic, maleic, fumaric, adipic, suberic, azelaic, sebacic, dodecanedioic, 1,2,4-butane-tricarboxylic, phthalic, linoleic acid dimer and the like. Suitable alcohols include methanol, n-butanol, 2-ethyl-n-butanol, pentanol, 1-hexanol, 2-ethylhexanol, 1-decanol, 1-dodecanol, 2-ethyloctanol, ethylene glycol, diethylene glycol monoethers, propylene glycol and the like. The preferred esters of this type include esters of $C_{10-20}$ alkanols with alkyl succinic and/or alkenyl succinic acids in which the alkyl or alkenyl group contains about 10–20 carbon atoms.

COMPONENT C

Component C is, as noted previously, an oil-soluble dispersant characterized by containing nitrogen and a substantially saturated aliphatic hydrocarbon-based radical (as defined hereinabove with reference to component B) having at least about 50 carbon atoms.

In addition to the substantially saturated aliphatic hydrocarbon-based radical, the oil-soluble dispersant contains a polar component comprising one or more nitrogen atoms, which are usually present as amino groups. Dispersants of this type are often known as "ashless dispersants", although, depending on its constitution, the dispersant may upon combustion yield a non-volatile material such as boric oxide or phosphorus pentoxide; however, it does not ordinarily contain metal and therefor does not yield a metal-containing ash on combustion.

Oil-soluble nitrogen-containing dispersants of many types are known in the art and are described in various patents. The particular types described herein may be classified as "carboxylic dispersants", "Mannich-type dispersants", "amine dispersants" (as well as post-treatment products of any of the foregoing) and "polymeric dispersants". For the purposes of this invention, the carboxylic, Mannich-type and amine dispersants are preferred, with a particular preference being expressed for carboxylic and Mannich-type dispersants. Dispersants of these types are described in detail hereinafter.

Carboxylic Dispersants

The carboxylic dispersants are generally products of the reaction between (I) a carboxylic acid-producing compound and (II) a nitrogen-containing compound such as an amine, either alone or in combination with an organic hydroxy compound such as a phenol or alcohol and/or a basic inorganic material. Examples of these products are described in British Pat. No. 1,306,529 and in many U.S. patents including the following:

| | | |
|---|---|---|
| 3,163,603 | 3,340,281 | 3,467,668 |
| 3,184,474 | 3,341,542 | 3,541,012 |
| 3,215,707 | 3,399,141 | 3,542,678 |
| 3,219,666 | 3,433,744 | 3,576,743 |
| 3,272,746 | 3,444,170 | 3,630,904 |
| 3,281,357 | 3,448,048 | 3,632,510 |
| 3,306,908 | 3,448,049 | 3,632,511 |
| 3,311,558 | 3,451,933 | Re 26,433 |
| 3,316,177 | 3,454,607 | |

The above-noted patents are incorporated by reference herein.

By "carboxylic acid-producing compound", with reference to reagent I is meant an acid or a derivative thereof such as an anhydride, acid halide, ester, amide, imide, amidine or the like; the acids and anhydrides are preferred. This reagent contains the substantially saturated aliphatic hydrocarbon-based radical previously referred to. Such radical should usually be substantially free from pendant groups containing more than about 6 aliphatic carbon atoms.

The preferred hydrocarbon-based radicals in reagent I are derived from substantially saturated petroleum fractions and olefin polymers, particularly polymers of monoolefins having from 2 to about 30 carbon atoms. Thus, the hydrocarbon-based radical may be derived from a polymer of ethylene, propene, 1-butene, isobutene, 1-octene, 3-cyclohexyl-1-butene, 2-butene, 3-pentene or the like. Other useful radicals are derived from interpolymers of olefins such as those illustrated above with other polymerizable olefinic substances such as styrene, chloroprene, isoprene, p-methylstyrene, piperylene and the like. In general, these interpolymers should contain at least about 80%, preferably at least about 95%, on a weight basis of units derived from the aliphatic monoolefins.

Among the olefin polymers those having a molecular weight of about 700–5000 are preferred, although higher polymers having molecular weights from about 10,000 to about 100,000 or higher may sometimes be used. Especially suitable are isobutene polymers within the prescribed molecular weight range, and chlorinated derivatives thereof.

Another source of suitable hydrocarbon-based radicals comprises saturated aliphatic hydrocarbons such as highly refined high molecular weight white oils or synthetic alkanes.

In many instances, the source of the hydrocarbon-based radical should contain an activating polar group. The preferred activating groups are halogen atoms, especially chlorine, but other suitable groups include sulfide, disulfide, nitro, mercaptan, ketone and aldehyde groups.

Any one of a number of known reactions may be employed for the preparation of reagent I. Thus, an alcohol of the desired molecular weight may be oxidized with potassium permanganate, nitric acid or a similar oxidizing agent; a halogenated olefin polymer may be reacted with a ketene; an ester of an active hydrogen-containing acid, such as acetoacetic acid, may be converted to its sodium derivative and the sodium derivative reacted with a halogenated high molecular weight hydrocarbon such as brominated wax or brominated polyisobutene; a high molecular weight olefin may be ozonized; a methyl ketone of the desired molecular weight may be oxidized by means of the haloform reaction; an organometallic derivative of a halogenated hydrocarbon may be reacted with carbon dioxide; a halogenated hydrocarbon or olefin polymer may be converted to a nitrile, which is subsequently hydrolyzed; or an olefin polymer or its halogenated derivative may undergo an addition reaction with an unsaturated acid or derivative thereof. This latter reaction is preferred, especially where the acid-producing compound is maleic acid or anhydride. The resulting product is then a succinic acid or derivative thereof containing a hydrocarbon-based radical. The reaction leading to its formation involves merely heating the two reactants at about 100°–200°C. The substituted succinic acid or anhydride thus obtained, may, if desired, be converted to the corresponding acid halide by reaction with known halogenating agents such as phosphorus trichloride, phosphorus pentachloride or thionyl chloride.

Reagent II is a nitrogen-containing compound, usually one which is characterized by a radical of the structure >NH wherein the two remaining valences of nitrogen are satisfied by hydrogen, amino or organic radicals bonded to said nitrogen atom through direct carbon-to-nitrogen linkages. These compounds include aliphatic, aromatic, heterocyclic and carbocyclic amines as well as substituted ureas, thioureas, hydrazines, guanidines, amidines, amides, thioamides, cyanamides and the like.

Especially preferred as reagent II are compounds in which the nitrogen atom is attached to a hydrocarbon radical or substituted hydrocarbon radical, especially an amino, alkylamino-, polyalkyleneamino-, hydroxy- or alkyleneoxy-substituted hydrocarbon radical. Suitable compounds of this type include the alkylene polyamines and hydroxyalkyl-substituted alkylene polyamines. The alkylene polyamines comprise, in general, alkylene amines containing about 10 or less alkylene groups joined through nitrogen atoms. They include principally the ethylene amines, propylene amines, butylene amines and homologs thereof, and also piperazines and aminoalkyl-substituted piperazines. Hydroxyalkyl-substituted derivatives of these alkylene polyamines are also contemplated for use in preparing the carboxylic dispersant. Typical examples of suitable amines are ethylene diamine, triethylene tetramine, pentaethylene hexamine, propylene diamine, tripropylene tetramine, di-(trimethylene) triamine, 1,4-bis-(2-aminoethyl)piperazine, 1-(2-aminopropyl)piperazine, N-(2-hydroxyethyl)ethylene diamine, 1-(2-hydroxyethyl)piperazine, N-aminopropylmorpho-line, and 2-heptadecyl-1-(2-hydroxyethyl)-imidazoline. Mixtures of these amines may also be used.

The preferred amines are the ethylene polyamines containing from 2 to about 8 amino groups per molecule. A commercially available mixture of polyethylene polyamines containing an average of about 3—7 amino groups per molecule is particularly suitable.

The above mentioned U.S. Pat. Nos. 3,219,666 and 3,272,746 described a number of especially suitable carboxylic dispersants and methods for their preparation. Such dispersants contain at least one acyl, acyloxy or acylimidoyl radical bonded directly to nitrogen. The structure of these radicals, as defined by the International Union of Pure and Applied Chemistry, are as follows (each R'' representing a hydrocarbon-based group or the like):

Acyl: $R''-\overset{\overset{\displaystyle O}{\|}}{C}-$

Acyloxy: $R''-\overset{\overset{\displaystyle O}{\|}}{C}-O-$

Acylimidoyl: $R''-\overset{\overset{\displaystyle NR''}{\|}}{C}-$

Carboxylic dispersants derived from hydrocarbon-substituted succinic acids and the like are usually prepared by heating a mixture of reagents I and II (as defined herein-above) to a temperature above about 80° C., preferably about 100°—250° C. The product thus obtained has predominantly amide, imide and/or amidine linkages (containing acyl or acylimidoyl groups). The reaction may in some instances be carried out at a temperature below 80° C. to produce a product having predominantly salt linkages (containing acyloxy groups). The use of diluent such as benzene, toluene, xylene, naphtha or the like is often desirable to facilitate control of the reaction temperature.

At least about one-half the stoichiometrically equivalent amount of reagent II is ordinarily used for each equivalent of reagent I. In this regard it will be noted that the equivalent weight of reagent II is based upon the number of amine radicals therein, and the equivalent weight of reagent I is based on the number of acidic or potentially acidic radicals. (Thus, the equivalent weight of a hydrocarbon-substituted succinic acid or anhydride is one-half its molecular weight.) Although a minimum of one-half equivalent of reagent II per equivalent of reagent I should be used, there does not appear to be an upper limit for the amount of reagent II. If an excess is used, it merely remains in the product unreacted without any apparent adverse effects. Ordinarily, no more than about 2 equivalents of reagent II are used per equivalent of reagent I.

In an alternative method for producing the carboxylic dispersant, reagent II is first reacted with a low molecular weight, unsaturated carboxylic acid-producing compound such as maleic anhydride and the resulting intermediate is subsequently reacted with the source of the hydrocarbon-based radical as previously described.

It is also possible to prepare carboxylic dispersants by reacting reagent I simultaneously or, preferably, sequentially with nitrogen-containing reagents such as those previously described and with hydroxy compounds such as alcohols or phenols. The preferred hydroxy compounds are alcohols containing up to about 40 aliphatic carbon atoms. These may be monohydric alcohols such as methanol, ethanol, isooctanol, dodecanol, cyclohexanol, neopentyl alcohol, ethylene glycol monomethyl ether and the like, or polyhydric alcohols including ethylene glycol, diethylene glycol, dipropylene glycol, tetramethylene glycol, pentaerythritol, glycerol and the like. Carbohydrates (e.g., sugars, starches, cellulose) are also suitable as are partially esterified derivatives of polyhydric alcohols having at least three hydroxy radicals.

The reaction with the hydroxy compound is usually effected at a temperature above about 100° C. and typically at 150°—300° C. The relative amounts of the nitrogen-containing and hydroxy reagents may be between about 10:1 and 1:10, on an equivalent weight basis. The methods of preparation of mixed carboxylic dispersants of this type are generally the same as for the individual dispersants described hereinabove, except that reagent II comprises one compound containing and one not containing reactive nitrogen. A typical method of producing suitable mixed carboxylic dispersants is to react the acylating agent with the hydroxy reagent first and subsequently react the intermediate thus obtained with a suitable nitrogen-containing reagent in an amount to afford a substantially neutral or acidic product.

Typical carboxylic dispersants suitable for use in preparing the compositions of this invention are listed in Table I. Xylene is used as a diluent in all instances.

TABLE I

| Example | Reagent I | Reagent II | Ratio of equivalents, I:II | Reaction temperature, ° C. |
|---|---|---|---|---|
| 1 | Polyisobutenyl (mol. wt. about 900) succinic anhydride prepared from chlorinated polyisobutene | Polyethylene amine mixture containing about 3–7 amino groups per molecule | 0.48 | 150 |
| 2 | Same as Example 1 | Pentaethylene hexamine | 0.41 | 150 |
| 3 | Like Example 1 except polyisobutene mol. wt. | Pentaethylene hexamine | 0.61 | 150 |

TABLE I-continued

| Example | Reagent I | Reagent II | Ratio of equivalents, I:II | Reaction temperature, °C. |
|---|---|---|---|---|
| | is about 1050 | | | |
| 4 | Like Example 1, except polyisobutene mol. wt. is about 850 | Diethylene triamine | 1.0 | 150 |
| 5 | Same as Example 4 | Ethylene diamine | 1.0 | 150 |
| 6 | Same as Example 4 | Di-(1,2-propylene)triamine | 1.0 | 180–190 |
| 7 | Same as Example 4 | N-(2-hydroxyethyl)-trimethylene diamine | 1.06 | 150–155 |
| 8 | Same as Example 1 | 20 parts (by weight) amine mixture of Example 1, 80 parts triethylene tetramine | 0.91 | 150 |
| 9 | Same as Example 1 | Same as Example 1 | 1.33 | 150 |
| 10 | like Example 1, except polyisobutene mol. wt. is about 1100 | Pentaerythritol, followed by polyethylene amine of Example 1 (ratio of equivalents 7.7:1) | 0.44 | 150–210 |
| 11 | Acid produced by reaction of chlorinated (3.6%Cl) polyisobutene (mol. wt. 750) with KCN, followed by hydrolysis | Ethylene diamine | 2.0 | 150 |
| 12 | Methyl ester produced by reaction of chlorinated (4.7%Cl) polyisobutene (mol. wt. 1000) with methyl methacrylate | Triethylene tetramine | 1.0 | 140–220 |
| 13 | Reaction product of sodio-malonic ester with $C_{75}$ brominated wax | Same as Example 1 | 0.4 | 150 |
| 14 | Reaction product of chlorinated (4.5%Cl) poly-isobutene (mol. wt. 850) with acrylic acid | Pentaethylene hexamine | 0.8 | 180–200 |
| 15 | Acid produced by haloform reaction with methyl heptacontanyl ketone | Same as Example 1 | 0.8 | 180–210 |

Mannich-Type Dispersants

Mannich-type dispersants are prepared by the reaction of a nitrogen compound such as those described hereinabove with respect to carboxylic dispersants, an aldehyde, and a hydroxyaromatic compound having a hydrocarbon-based substituent (as described hereinabove) containing at least about 50 carbon atoms. The preparation of suitable Mannich-type dispersants is disclosed in copending application Ser. No. 451,644, filed Mar. 15, 1974, and in a number of U.S. patents of which the following are illustrative:

| | |
|---|---|
| 3,368,972 | 3,697,574 |
| 3,413,347 | 3,725,277 |
| 3,649,229 | 3,726,882 |

The disclosures of these patents are incorporated by reference herein.

The preferred hydroxyaromatic compounds for use in the preparation of Mannich-type dispersants are phenols containing a substituent derived from a polymer of propylene, 1-butene or isobutene. The preferred aldehyde is formaldehyde or a reversible polymer thereof, and the preferred nitrogen-containing compounds are aliphatic amines, especially alkylene polyamines as described hereinabove. Other suitable amino compounds include ureas, thioureas, hydroxylamines, hydrazines, guanidines, amidines, amides, thioamides, cyanamides and the like.

The reaction between the phenol, aldehyde and nitrogen compound may be effeced in one step, by merely heating three reagents to a temperature (usually about 50°—200° C. at which reaction takes place; or it may be effected in two steps, by first reacting the phenol with the aldehyde, usually in the presence of an alkaline reagent, and subsequently neutralizing the intermediate thus formed and reacting the neutralized intermediate with the nitrogen compound.

The following example illustrates a typical procedure for the preparation of a Mannich-type dispersant. All parts are by weight.

EXAMPLE 16

A mixture of 1792 parts (1.6 equivalents) of a polyisobutenylphenol having a molecular weight of about 885 and 1350 parts of xylene is heated to 60° C. and 12.8 parts (0.16 equivalent) of 50% aqueous sodium hydroxide solution is added, with stirring. The mixture is stirred at 60°—65° C. for 10 minutes, and then 108 parts (3.28 equivalents) of paraformaldehyde is added. Heating is continued at 65°—75° C. for 5 hours, after which 14.3 parts (0.24 equivalent) of acetic acid is added. The acidified mixture is heated at 75°—125° C. for ½ hour and then stripped under vacuum. The resulting intermediate solution is filtered through a filter aid material.

To 2734 parts (1.4 equivalents) of the above-described intermediate, maintained at 65° C., is added 160.7 parts (3.92 equivalents) of the polyethylene polyamine of Example 1. The mixture is heated for 1½ hours at 65°—110° C. and for 1½ hours at 110°—140° C., after which heating at 140° C. is continued with nitrogen blowing for 11 hours, while a xylene-water azeotrope is collected by distillation. The residual liquid is filtered at 100° C. using a filter aid material, and the filtrate is the desired product (60% solution in xylene) containing 1.79% nitrogen.

Amine Dispersants

The amine dispersants contemplated for use according to this invention are generally the reaction products of aliphatic or alicyclic halides, ketones or the like containing at least about 50 carbon atoms (preferably a chlorinated polyisobutene) with amines (preferably alkylene polyamines as described hereinabove with reference to carboxylic dispersants, and especially ethylene polyamines). Examples thereof are described, for example, in the following U.S. patents which are incorporated by reference herein:

| | |
|---|---|
| 3,275,554 | 3,454,555 |
| 3,438,757 | 3,565,804 |
| | 3,821,302 |

Post-Treatment Products

The above-described carboxylic, Mannich-type or amine dispersants may be post treated with various reagents including urea, thiourea, carbon disulfide, aldehydes, ketones, carboxylic acids, hydrocarbon-substituted succinic anhydrides, nitriles, epoxides, boron compounds, phosphorus compounds and the like. Such post-treatment products are also contemplated as dispersants useful in this invention. The following U.S. patents are incorporated by reference herein for their disclosures of post-treatment products:

| | | |
|---|---|---|
| 3,036,003 | 3,278,550 | 3,367,943 |
| 3,087,936 | 3,281,428 | 3,373,111 |
| 3,200,107 | 3,282,955 | 3,415,750 |
| 3,216,936 | 3,312,619 | 3,442,808 |
| 3,254,025 | 3,346,493 | 3,455,831 |
| 3,256,185 | 3,366,569 | 3,455,832 |
| 3,502,677 | 3,600,372 | 3,703,536 |
| 3,513,093 | 3,649,659 | 3,704,308 |
| 3,539,633 | 3,658,836 | 3,708,522 |
| 3,573,010 | 3,697,574 | 3,726,480 |
| 3,591,598 | 3,702,757 | |

Polymeric Dispersants

Also useful as dispersants are interpolymers of oil-solubilizing monomers containing a pendant alkyl group having at least about 8 carbon atoms, such as decyl methacrylate, vinyl decyl ether or a relatively high molecular weight olefin, with polar nitrogen-containing monomers such as aminoalkyl acrylates, aminoalkyl acrylamides or N-vinyloxa-zolidone. In the polymeric dispersants, the polymer chain is the substantially saturated hydrocarbon-based radical. Suitable polymeric dispersants are exemplified in the following U.S. patents, which are likewise incorporated by reference herein:

| | |
|---|---|
| 3,329,658 | 3,687,849 |
| 3,449,250 | 3,702,300 |
| 3,493,520 | |

The compositions of this invention generally contain about 50—500 and preferably about 100—400 parts by weight of component B, and about 40—500 parts and preferably about 80—400 parts by weight of component C, per million parts of component A. In addition to components A, B and C, the compositions may contain other additives which are known to those skilled in the art, including anti-knock agents such as tetraalkyl-lead compounds, lead scavengers such as the haloalkanes, deposit preventers or modifiers such as the triaryl phosphates, dyes , anti-oxidants such as 2,6-di-t-butyl-4-methylphenol, rust inhibitors such as alkylated succinic acids, auxiliary dispersants such as the lower molecular weight carboxylic dispersants or Mannich reaction products otherwise similar to those described hereinabove, demulsifiers, bacteriostatic agents, gum inhibitors, metal deactivators, upper cylinder lubricants, and the like.

SPECIFIC EMBODIMENT

Typical fuel compositions of this invention are listed in Table II. In each instance the fuel is gasoline, and the concentrations of the other ingredients are listed as parts by weight per million parts of fuel. All amounts, except those for xylene and isooctyl alcohol, are exclusive of diluents.

TABLE II

| Ingredient | APPENDIX 17 | 18 | 19 | 20 | 21 | 22 |
|---|---|---|---|---|---|---|
| "Hercoflex 707A" mixed pentaerythritol and tripentaerythritol esters of predominantly straight chain $C_{5-10}$ aliphatic carboxylic acids | — | — | 184.0 | 400.0 | — | — |
| "Hercolube F" dipentaerythritol ester of predominantly straight-chain $C_{5-10}$ aliphatic carboxylic acids | 208 | 104.0 | — | — | — | — |
| Tridecyl ester of $C_{15-18}$ alkenyl succinic acid | — | — | — | — | 104.0 | 207.9 |
| Product of Example 8 | 89.9 | 89.9 | 402.0 | 402.0 | 44.9 | — |
| Product of Example 16 | — | — | — | — | — | 89.8 |
| Ethoxylated reaction product of oleic-naphthenic mixture with polyethylene polyamine mixture | 3.1 | 3.1 | 13.8 | 13.8 | 1.5 | — |
| Exxon Proprietary demulsifier composition | 2.1 | 2.1 | 9.2 | 9.2 | 1.1 | 4.0 |
| Tretolite proprietary demulsifier composition | 2.1 | 2.1 | 9.2 | 9.2 | 1.1 | 2.0 |
| Nalco proprietary dehazer | 3.0 | 3.0 | 13.3 | 13.3 | 1.5 | 2.0 |
| Isooctyl alcohol | 31.0 | 31.0 | 138.7 | 138.7 | 15.5 | 48.8 |
| Xylene | 97.0 | 97.0 | 433.9 | 433.9 | 48.5 | 133.5 |

What is claimed is:

1. A fuel composition comprising a major amount of (A) a normally liquid fuel and a minor dispersant amount of the combination of; (B) at least one liquid ester of a $C_{10-20}$ alkanol and an alkyl succinic or alkenyl succinic acid in which the alkyl or alkenyl group contains about 10—20 carbon atoms; and (C) an oil soluble nitrogen-containing dispersant having within its molecular structure a substantially saturated aliphatic hydro-carbon-based radical having at least about 50 carbon atoms.

2. A composition according to claim 1 wherein component C is selected from the group consisting of carboxylic dispersants, Mannich-type dispersants and amine dispersants.

3. A composition according to claim 2 wherein component A is gasoline.

4. A composition according to claim 3 wherein the alkanol is tridecyl alcohol.

5. A composition according to claim 2 wherein component C is a carboxylic dispersant.

6. A composition according to claim 5 wherein component A is gasoline.

7. A composition according to claim 6 wherein component C is the reaction products of a succinic acid-producing compound containing a hydrocarbon-based substituent having at least about 50 carbon atoms and a nitrogen reagent comprising an alkylene polyamine or hydroxyl-alkyl-substituted alkylene polyamine.

8. A composition according to claim 7 wherein the nitrogen reagent is an ethylene polyamine containing from 2 to about 8 amino groups per molecule.

9. A composition according to claim 8 wherein the hydrocarbon-based substituent is derived from an olefin polymer.

10. A composition according to claim 9 wherein the olefin polymer is polyisobutene.

11. A composition according to claim 2 wherein component C is a Mannich-type dispersant.

12. A composition according to claim 11 wherein component A is gasoline.

13. A composition according to claim 12 wherein component C is prepared by the reaction of formaldehyde, an alkylene polyamine and a phenol containing a hydrocarbon-based substituent having at least about 50 carbon atoms and derived from a polymer of propylene, 1-buetne or isobutene.

14. A composition according to claim 13 wherein the hydrocarbon-based substituent is prepared from an isobutene polymer.

15. A composition according to claim 14 wherein the alkylene polyamine is an ethylene polyamine containing from 2 to about 8 amino groups per molecule.

16. A composition according to claim 2 wherein component C is an amine dispersant.

17. A composition according to claim 16 wherein component A is gasoline.

18. A composition according to claim 17 wherein component C is the reaction product of an aliphatic or alicyclic halide containing at least about 50 carbon atoms and an alkylene polyamine.

19. A composition according to claim 18 wherein component C is prepared by the reaction of a chlorinated polyisobutene with an ethylene polyamine containing from 2 to about 8 amino groups per molecule.

* * * * *